US011066219B1

(12) United States Patent
Bakovsky

(10) Patent No.: US 11,066,219 B1
(45) Date of Patent: Jul. 20, 2021

(54) PORTABLE DRINKING BOTTLE WITH AN AUXILIARY CASING FOR ARTICLES

(71) Applicant: Jacob Bakovsky, Santa Ana, CA (US)

(72) Inventor: Jacob Bakovsky, Santa Ana, CA (US)

( * ) Notice: Subject to any disclaimer, the term of this patent is extended or adjusted under 35 U.S.C. 154(b) by 192 days.

(21) Appl. No.: 16/244,349

(22) Filed: Jan. 10, 2019

(51) Int. Cl.

| | |
|---|---|
| ***B65D 1/04*** | (2006.01) |
| ***B65D 25/04*** | (2006.01) |
| ***B65D 51/28*** | (2006.01) |
| ***B65D 51/24*** | (2006.01) |
| ***B65D 43/02*** | (2006.01) |
| ***B65D 81/38*** | (2006.01) |
| ***A47G 19/22*** | (2006.01) |
| ***B65D 1/02*** | (2006.01) |
| ***B65D 43/16*** | (2006.01) |
| ***B65D 23/10*** | (2006.01) |

(52) U.S. Cl.
CPC ..... *B65D 51/246* (2013.01); *A47G 19/2205* (2013.01); *B65D 1/0246* (2013.01); *B65D 1/04* (2013.01); *B65D 23/108* (2013.01); *B65D 43/0231* (2013.01); *B65D 43/164* (2013.01); *B65D 81/3837* (2013.01)

(58) Field of Classification Search
CPC ..... A47G 19/2205; A47G 19/186; B65D 1/0246; B65D 1/04; B65D 23/108; B65D 25/04; B65D 43/0231; B65D 43/164; B65D 43/0212; B65D 47/06; B65D 51/246; B65D 77/245; B65D 81/3837; B65D 85/73; B65D 47/265; A45F 3/16; A45F 2200/00583
USPC .... 206/217, 6, 223, 541, 538; 220/505, 524, 220/23.87, 23.98, 592.28, 500; 222/129, 222/142.6, 142.9; 229/401; 215/6, 215/DIG. 5
See application file for complete search history.

(56) References Cited

U.S. PATENT DOCUMENTS 1,539,201 A * 5/1925 Ottow ..... B65D 23/108 294/31.2
1,896,976 A * 2/1933 Schifferdecker ..... G07D 9/02 220/253
3,120,974 A * 2/1964 Matson ..... B65D 23/108 294/31.2
3,127,984 A * 4/1964 Hertzog ..... A45C 11/20 206/545
3,266,623 A * 8/1966 Poferl ..... A47J 47/14 206/541
3,439,841 A * 4/1969 Rhodes ..... B65D 81/3227 222/142.5

(Continued)

*Primary Examiner* — Gideon R Weinerth
(74) *Attorney, Agent, or Firm* — Sanchelima & Associates, P.A.; Christian Sanchelima; Alexander Rodriguez

(57) ABSTRACT

The present invention is a portable drinking bottle for carrying re-usable articles like spoons, fork and knives and preventing the need of disposable polymeric articles and hence save environment. Portable drinking bottle includes a main casing and an auxiliary casing, an inner closure and an outer closure. Auxiliary casing is introduced in main casing to form a cavity therebetween so that drinking liquid can be filled therewithin. Main casing and auxiliary casing are enclosed by an inner closure that has a central aperture to insert in and remove articles from auxiliary casing. Inner closure also has a spout which is in connection with cavity and hence enables drinking of liquid. Also, auxiliary casing can be removed for cleaning or when not desired thus providing a simple structure.

14 Claims, 5 Drawing Sheets

(56) References Cited

U.S. PATENT DOCUMENTS 4,194,619 A * 3/1980 Schley ..... A45F 3/16 206/217
5,318,183 A * 6/1994 Cohen ..... B65D 77/0493 206/528
5,509,551 A * 4/1996 Terrell, II ..... A47G 19/2266 215/229
5,535,889 A * 7/1996 Lin ..... A45C 11/20 206/546
5,588,561 A * 12/1996 Ness ..... A47G 19/02 206/217
5,890,627 A * 4/1999 Storey ..... B65D 25/04 222/129
5,938,053 A * 8/1999 Verbovszky ..... A47G 19/2272 215/11.1
6,610,339 B1 * 8/2003 Borgerson ..... B65D 51/246 206/219
7,607,386 B2 * 10/2009 Wise ..... A47J 31/0576 220/525
8,925,768 B1 * 1/2015 Ismail ..... G01F 11/261 222/434
9,360,248 B1 * 6/2016 Efferding ..... B65D 69/00
10,544,030 B2 * 1/2020 Ewing ..... B67D 3/045
2003/0052018 A1 * 3/2003 Wilson ..... A47G 19/22 206/217
2006/0283763 A1 * 12/2006 Beaty ..... A47G 19/00 206/542
2012/0168440 A1 * 7/2012 Nerswick ..... B65D 47/06 220/212
2012/0228305 A1 * 9/2012 Peng ..... B65D 51/248 220/500
2012/0285845 A1 * 11/2012 Jackson ..... A47G 19/186 206/223
2013/0153085 A1 * 6/2013 Shefler ..... B65D 1/04 141/9
2013/0240535 A1 * 9/2013 Grajqevci ..... B65D 51/22 220/524
2017/0313463 A1 * 11/2017 Little ..... B65D 11/04
2018/0016051 A1 1/2018 Buehrle
2018/0170634 A1 6/2018 Woodruff
2018/0192802 A1 * 7/2018 Johnson ..... B65D 77/245
2018/0215506 A1 * 8/2018 Burns ..... A45F 3/16
2018/0312321 A1 * 11/2018 Wondka ..... B65D 51/1644
2018/0327174 A1 * 11/2018 Daniels, Jr. ..... A61J 1/03
2019/0061984 A1 * 2/2019 Pell ..... A47G 19/2205
2020/0223589 A1 * 7/2020 Wondka ..... B65D 43/022

* cited by examiner

PORTABLE DRINKING BOTTLE WITH AN AUXILIARY CASING FOR ARTICLES

II. BACKGROUND OF THE INVENTION

1. Field of the Invention

The present disclosure relates to a portable drinking bottle. More particularly, the present disclosure relates to a portable drinking bottle having an auxiliary casing for articles.

2. Description of the Related Art

It is difficult to carry utensils like spoons, forks or knives everyday while on work, school or picnic especially when utensils are used. Hence, it is preferred to carry disposable utensils which are made of polymeric material and disposed after use. Disposing causes environmental pollution. As one carries a portable drinking bottle, it is desired that a portable drinking bottle facilitates to carries re-usable utensils or other articles.

Several designs for various portable drinking bottles have been designed in the past. None of them, however, includes a portable drinking bottle that along with carrying drinking liquid also carries one or more articles.

Applicant believes that a related reference corresponds to a US patent application US20180016051 filed by Houston Max Buehrle for a portable canteen with storage compartments. The patent application '051 discloses a canteen having a main body with two separate and distinct cavities, each of which may function as a storage compartment. However, as the partition of two compartments is horizontal, one or both compartments will not able to provide sufficient area to store longitudinal items such as spoon or forks.

Another related application is WIPO patent application number US20180170634 by JEREMY Lynn WOODRUFF for a multi-function bottle for liquid. The patent application '634 discloses a bottle for containing liquids having a cap portion and a liquid containing portion. The cap portion is removably attached to the liquid containing portion. A variety of tools may be removably attached to the cap portion. However, tools get in contact with the liquid and render it useless drinking use.

Other documents describing the closest subject matter provide for a number of more or less complicated features that fail to solve the problem in an efficient and economical way. None of these patents suggest the novel features of the present invention.

III. SUMMARY OF THE INVENTION

It is an object of the present invention to provide a portable drinking bottle for carrying re-usable articles, such as spoons, fork, knives or chopsticks, and preventing the need of disposable polymeric articles and hence save environment.

It is another object of the present invention to provide a portable drinking bottle having a main casing for carrying liquid and an auxiliary casing within main casing for receiving articles.

It is still another object of the present invention to provide a portable drinking bottle that is simple in construction and easy to clean by disassembling auxiliary casing from main casing.

It is yet another object of the present invention to provide a portable drinking bottle that has main casing and auxiliary casing separable from main casing such that main casing is usable without auxiliary casing.

It is an object of the present invention to provide a portable drinking bottle that has an auxiliary casing for carrying longitudinal articles.

Further objects of the invention will be brought out in the following part of the specification, wherein detailed description is for the purpose of fully disclosing the invention without placing any limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents a perspective view of a portable drinking bottle 10 that is closed by an outer closure and has a carrying handle.

FIG. 2 represents an internal view of portable drinking bottle 10 depicting a main casing and an auxiliary casing introduced in main casing to form a cavity and cavity is filled with liquid. Auxiliary casing holds articles like spoon and fork. Main casing and auxiliary casing are covered by inner closure and outer closure. Inner closure is defined with a spout for drinking liquid after opening of outer closure.

V. DETAILED DESCRIPTION OF THE EMBODIMENTS OF THE INVENTION

Figure 1:
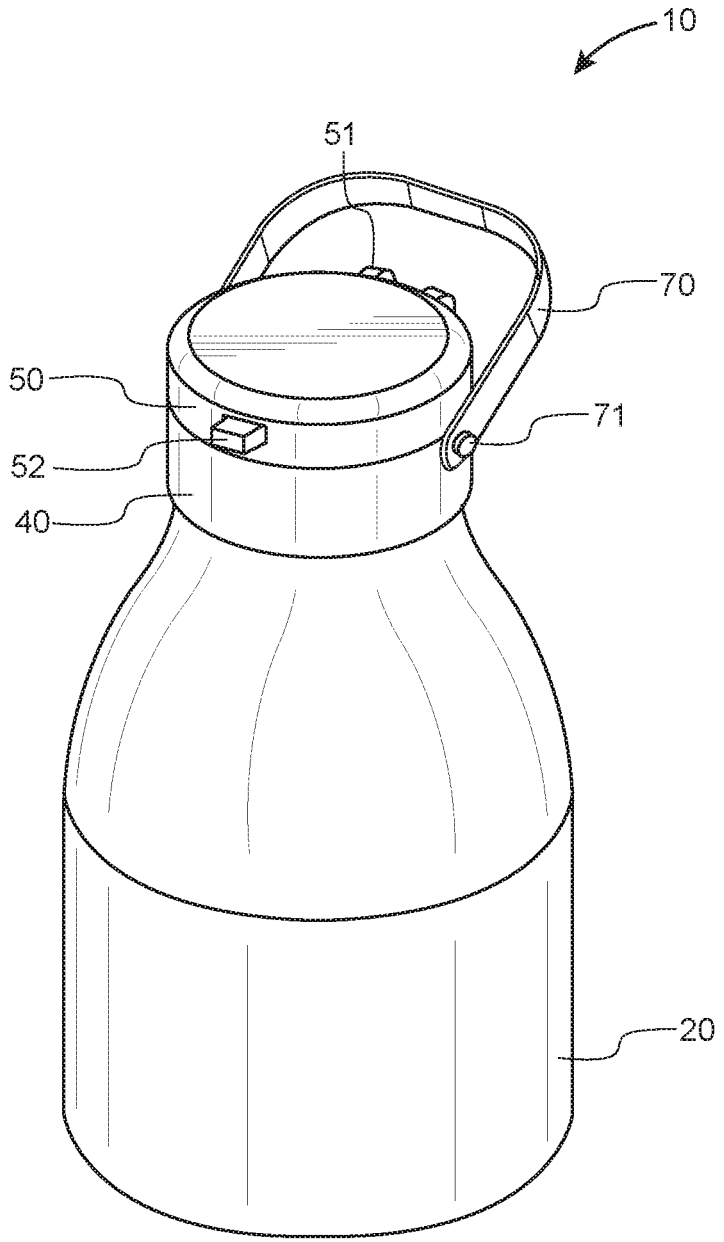
Figure 2:
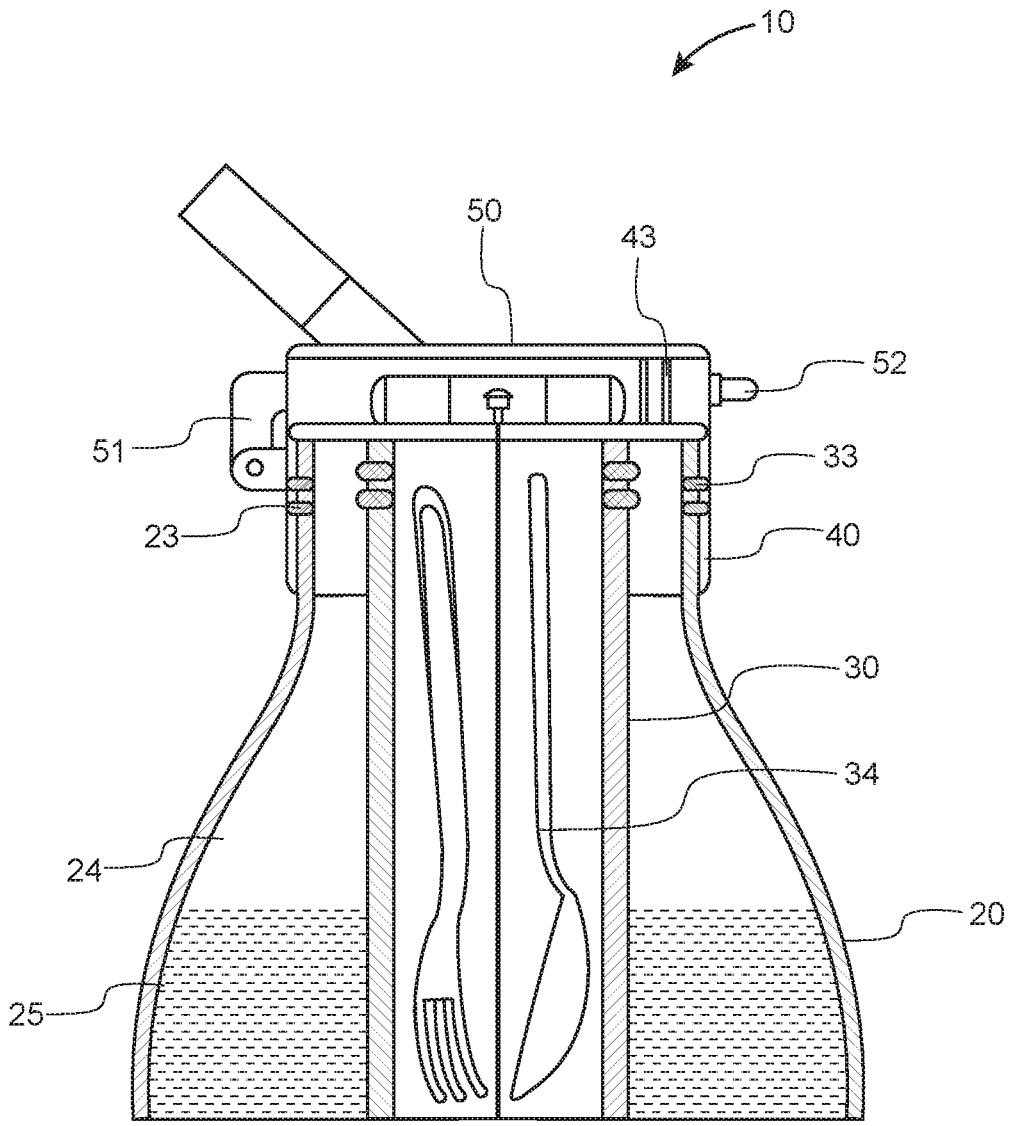
Figure 3:
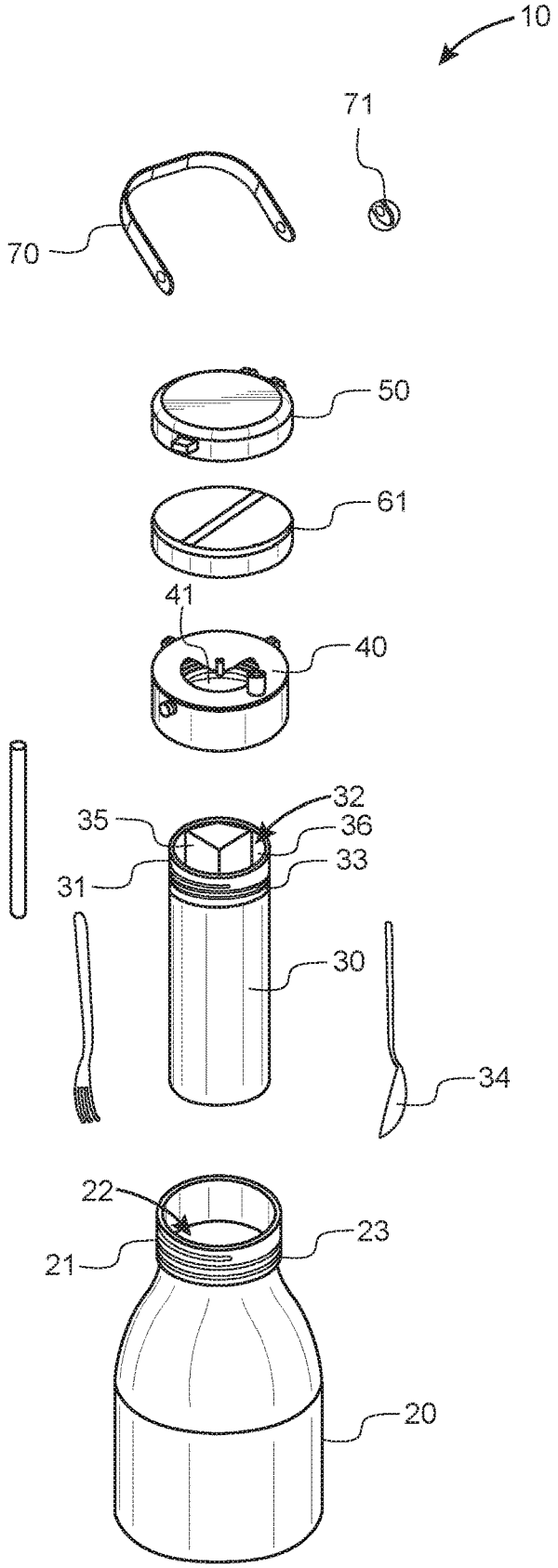
FIG. 3 represents an exploded view of portable drinking bottle 10.
Figure 4:
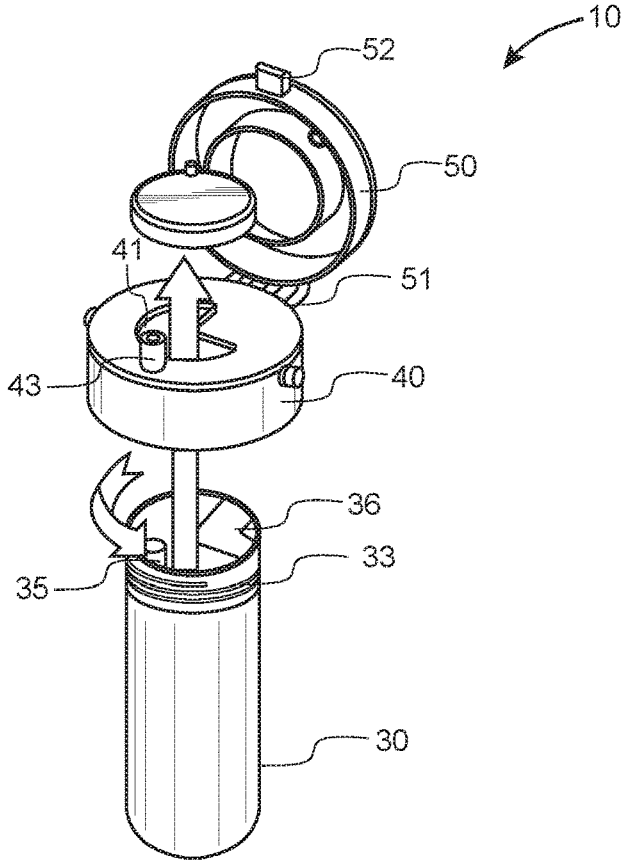
FIG. 4 represents an exploded view of auxiliary casing and assembly of inner closure and outer closure.
Figure 5:
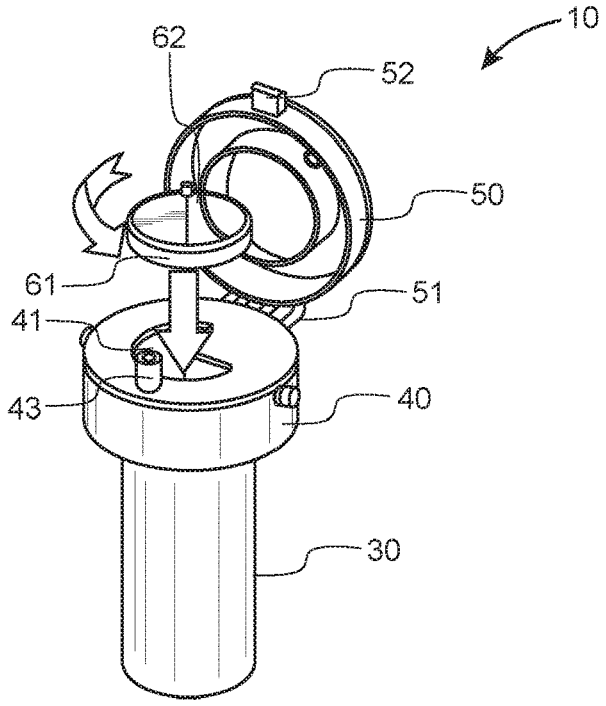
FIG. 5 represents an assemble view of auxiliary casing and assembly of inner closure and outer closure and a central cover disposed therebetween.
Figure 6:
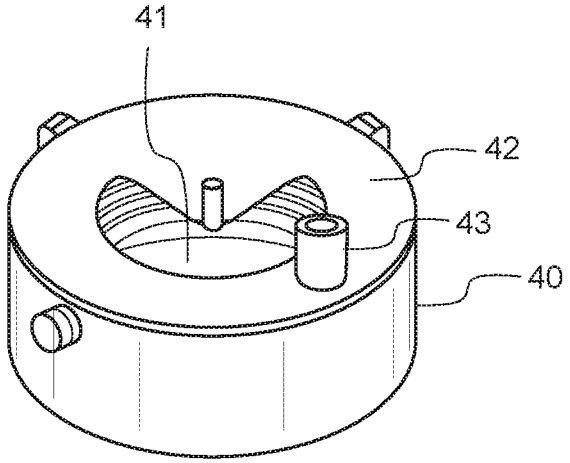
FIG. 6 represents a perspective view of inner cover.
Figure 7:
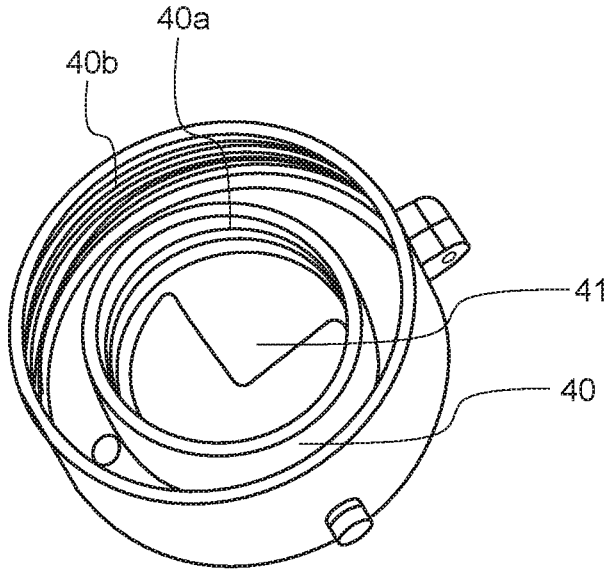
FIG. 7 represents a perspective view of inner cover in upside down configuration.

Referring now to the drawings, FIGS. 1-7, where the present invention is generally referred to with numeral 10, it can be observed that a portable drinking bottle, in accordance with one embodiment, is provided that mainly includes a main casing 20, an auxiliary casing 30, an inner closure 40 and an outer closure 50.

Main casing 20 is defined with a bottle neck 21 having a first opening 22. In one embodiment, a portion of outer surface of bottle neck 21 is configured with outer threads 23. In one embodiment, main casing 20 is provided can be optionally provided with a thermal insulation (not illustrated in Figures). In one embodiment, main casing 20 can be a canteen or a regular bottle.

Auxiliary casing 30 is removably inserted in main casing 20 through first opening 22 such that a cavity 24 is formed therebetween. Cavity 24 is filled with drinking liquid 25. Drinking liquid 25 can be water, juices, soups or any other liquids. Auxiliary casing 30 is defined with an auxiliary neck 31 having a second opening 32 through which at least one article 34 is introduced in auxiliary casing 30 and removed from auxiliary casing 30. Auxiliary neck 31 is provided with outer threads 33. In one embodiment, auxiliary casing 30 is partitioned with at least one partition wall 36 to form a plurality of storage compartments 35.

Inner closure 40 is removably connected with main casing 20 and auxiliary casing 30. In one embodiment, inner closure 40 has first internal threads 40*a* which is threadably connected with outer threads 23 and second internal threads 40*b* is threadably connected with outer threads 33. Inner closure 40 is defined with at least one central aperture 41 and an outer portion 42. Central aperture 41 can be of different predefined shapes such that an article 34 from one storage compartment 35 can be removed at a particular instance. In one embodiment, outer portion 42 covers cavity 24 and is defined with a spout 43 extending from the upper surface of outer portion 42 such that liquid in cavity 24 is directed out when lifted. In another embodiment, instead of spout 43, an opening (not illustrated in Figures) can be provided inside through which a removable straw (not illustrated in Figures) can be inserted and liquid can be sucked therefrom.

Outer closure 50 removably covers inner closure 40. In one embodiment, outer closure 50 is in hinge connection 51 with inner closure 40 and provided with a protrusion 52 for opening and closing. Outer closure 50 is press-fitted with inner closure 40 to facilitate locking therebetween.

In one embodiment, a central cover 61 is provided that covers central aperture 41. Central cover 61 is defined with a window portion 62 that when turned to be in-line with defined central aperture 41 provides access to desired storage compartment 35.

In one embodiment, a carrying handle 70 is provided that facilitates carrying of portable drinking bottle 10 at various places. In one embodiment, carrying handle 70 is connected to inner closure 40 by a connecting lock 71. In another embodiment, carrying handle 70 can be connected to body portion of main casing 20.

In one embodiment, at least one article is one or more utensils such as a spoon, a fork, a knife and chopsticks. However, articles are not limited to utensils and other articles such as tissue papers or other small sized articles can be introduced in auxiliary casing 30. As there is easiness in carrying articles like re-usable or used spoons or forks in portable drinking bottle 10, one can avoid disposable spoons or forks made of polymeric material and hence prevent environment hazardous plastic pollution.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A portable drinking bottle comprising:

a) a main casing defined with a first opening; and b) an auxiliary casing removably inserted in said main casing through said first opening such that a cavity is formed therebetween, said cavity filled with drinking liquid, said auxiliary casing defined with a second opening through which at least one article is introduced and removed, said auxiliary casing being in constant abutting contact with a floor of said main casing when inserted therein, said auxiliary casing including a plurality of storage compartments within, said plurality of compartments extending vertically an entire height of said auxiliary casing:

c) an inner closure removably connected with said main casing and said auxiliary casing and defined with at least one central aperture and an outer portion surrounding said central aperture, said inner closure covering said cavity and said auxiliary casing simultaneously, said inner closure simultaneously engaging said main casing and said auxiliary casing, said inner closure being entirely above of said auxiliary casing and said cavity, said central aperture provided for accessing said auxiliary casing and said outer portion defined with a spout extending therefrom; and d) an outer closure removably secured atop of said inner closure and covering said inner closure, said spout positioned between said inner closure and said outer closure in constant abutting contact with said inner closure and said outer closure simultaneously when said outer closure is secured atop of said inner closure.

2. The portable bottle as claimed in claim 1, wherein said inner closure is in thread connection with said main casing, said thread connection being along an inner circumference of said inner closure.

3. The portable bottle as claimed in claim 2, wherein said thread connection is entirely below said at least one aperture.

4. The portable bottle as claimed in claim 1, wherein said main casing is thermally insulated.

5. The portable bottle as claimed in claim 1, wherein said plurality of storage compartments are defined by at least one partition wall within said auxiliary casing, said at least one partition wall extending the entire height of said auxiliary casing.

6. The portable bottle as claimed in claim 1, wherein said outer closure is in hinged connection with said inner closure and is press-fitted for locking, said outer closure including a protrusion opposite to said hinged connection, said protrusion facilitating opening and closing of said outer closure.

7. The portable bottle as claimed in claim 1, further includes a carrying handle connected to said inner closure by a connecting lock, said carrying handle being U shaped, said connecting lock being located at lateral sides of said carrying handle, said connecting lock being visible and extending outwardly and away from said inner closure.

8. The portable bottle as claimed in claim 1, further comprises a central cover to cover said central aperture, said central cover defined with a window portion to access said auxiliary casing.

9. The portable bottle as claimed in claim 1, wherein said at least one article is one or more utensils.

10. The portable bottle as claimed in claim 9, wherein said utensil includes, but not limited to, at least one of a spoon, a fork, a knife and chopsticks.

11. The portable bottle as claimed in claim 1, wherein said main casing is tapered and flares outwardly towards a bottom end thereon, said auxiliary casing being cylindrical in shape.

12. The portable bottle as claimed in claim 1, wherein said at least one aperture extends a partial width of said inner closure.

13. The portable bottle as claimed in claim 1, wherein said at least one aperture is crescent shaped.

14. A portable drinking bottle consisting of:

a) a main casing defined with a first opening, said main casing being tapered; and b) an auxiliary casing removably inserted in said main casing through said first opening such that a cavity being formed therebetween, said cavity filled with drinking liquid, said auxiliary casing defined with a second opening and partitioned with at least one partition wall to form a plurality of storage compartments, each of said plurality of storage compartments configured to receive at least one utensil, said cavity extending about a circumference of said auxiliary casing, said at least one partition wall and said plurality of storage compartments extend an entire height of said auxiliary casing, said auxiliary casing being in constant abutting contact with a floor of said main casing when inserted therein;

c) an inner closure threadably connected with said first opening and defined with at least one central aperture and an outer portion surrounding said central aperture, said central aperture provided for accessing said auxiliary casing and said outer portion defined with a spout extending therefrom, said inner closure covering said cavity and said auxiliary casing simultaneously, said inner closure simultaneously engaging said main casing and said auxiliary casing, said inner closure being entirely above of said auxiliary casing and said cavity, said central aperture extending a partial width of said inner closure;

d) an outer closure in hinge connection with said inner closure and press-fitted for establishing lock therebetween, said outer closure including a protrusion opposite of said hinge connection on said outer closure, said protrusion facilitating opening and closing of said outer closure;

e) a carrying handle connected to said inner closure by a connecting lock, said connecting lock being located at lateral sides of said carrying handle; and f) a central cover to cover said central aperture, said central cover defined with a window portion to access said auxiliary casing, said central cover located between said inner closure and said outer closure, said spout being sandwiched between said inner closure and said outer closure in constant abutting contact therewith, simultaneously.

* * * * *